US006474090B2

(12) United States Patent
Guerra

(10) Patent No.: US 6,474,090 B2
(45) **Date of Patent: *Nov. 5, 2002**

(54) THEMED SNOW APPARATUS

(76) Inventor: Francisco Javier Guerra, 9715 W. Broward Blvd. #217, Plantation, FL (US) 33324

( * ) Notice: Subject to any disclaimer, the term of this patent is extended or adjusted under 35 U.S.C. 154(b) by 0 days.

This patent is subject to a terminal disclaimer.

(21) Appl. No.: 09/996,174

(22) Filed: Nov. 20, 2001

(65) Prior Publication Data

US 2002/0033022 A1 Mar. 21, 2002

Related U.S. Application Data

(63) Continuation-in-part of application No. 09/664,271, filed on Sep. 18, 2000, now Pat. No. 6,321,559.

(51) Int. Cl.[7] ..... F25C 1/00

(52) U.S. Cl. ..... 62/347; 239/2.2

(58) Field of Search ..... 62/347; 239/2.2

(56) References Cited

U.S. PATENT DOCUMENTS

| | | | | | |
|---|---|---|---|---|---|
| 4,813,598 | A | * | 3/1989 | Kosik et al. | 209/314 |
| 4,901,920 | A | * | 2/1990 | Wollin | 239/14.2 |
| 5,180,106 | A | * | 1/1993 | Handfield | 239/14.2 |
| 5,887,791 | A | * | 3/1999 | Rothe | 239/14.2 |
| 5,961,041 | A | * | 10/1999 | Sekihara et al. | 239/14.2 |

* cited by examiner

*Primary Examiner*—William E. Tapolcai
*Assistant Examiner*—Mohammad M. Ali
(74) *Attorney, Agent, or Firm*—David W. Barman

(57) ABSTRACT

A Machine and method for producing the illusion of snow is disclosed and described. It produces said product in a manner such that is easier to manufacture, operate, and produce than is currently available. Said machine is housed within a snowman or other winter themed housing.

10 Claims, 8 Drawing Sheets

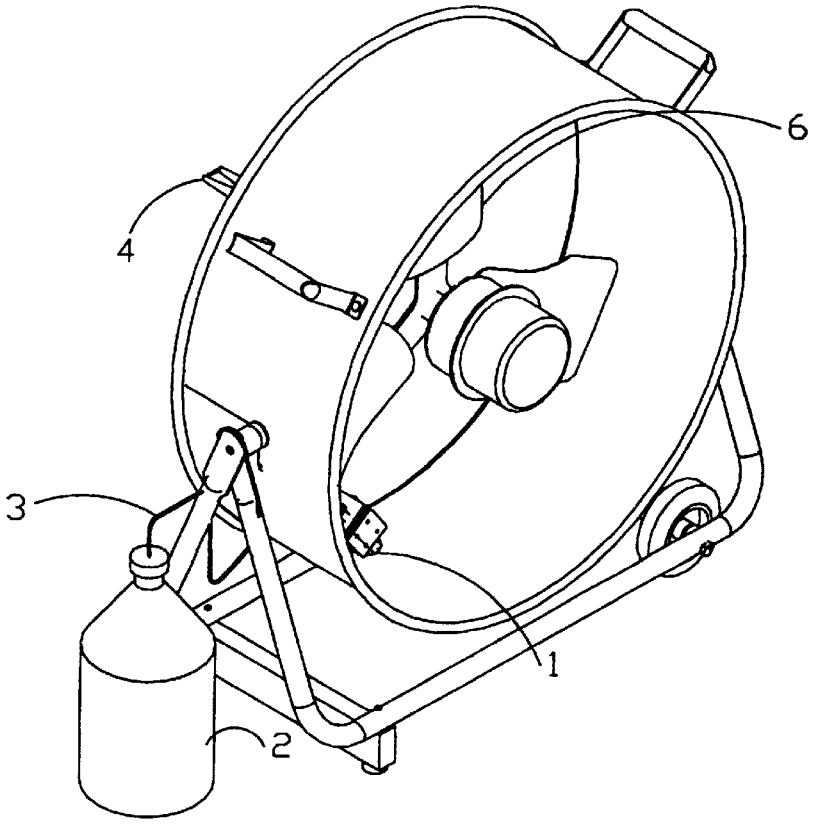
FIG 1
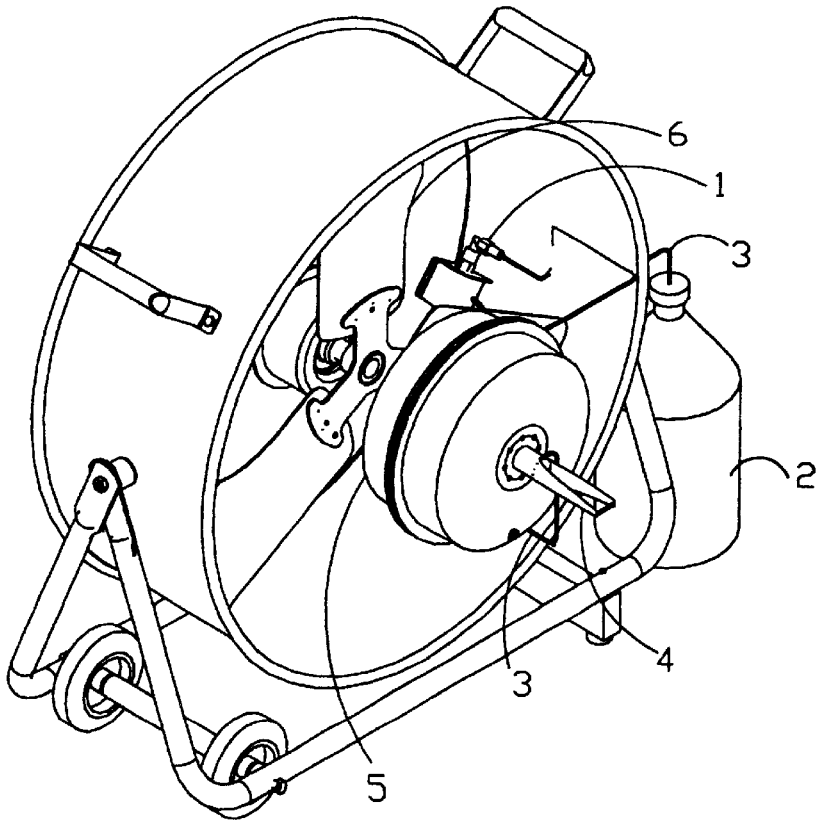

THEMED SNOW APPARATUS

CROSS REFERENCE TO RELATED APPLICATIONS

This is a continuation-in-part of patent application Ser. No. 09/664,271 filed Sep. 18, 2000 now U.S. Pat. No. 6,321,559.

FIELD OF THE INVENTION

This invention relates to the production of illusionary snow. More particularly, a machine which capable of creating the illusion of snow for theatrical or special effect purposes without the use of refrigeration, and without causing the accumulation of any residual moisture in the area in which it is used. The machine for producing the evaporative snow is contained within a snowman, producing a winter and/or Christmas theme display.

BACKGROUND OF THE INVENTION

The world of theater and special effects has prided itself on the ability to create illusions. The masters of this art are continually creating their magic for the entertainment of their patrons. One of the most challenging illusions is that of snow. This presents a distinct difficulty. Limitations based on temperature and accumulation of moisture have always plagued the special effects creators. There are many commercially available machines for producing snow. Many of these liquid based snow machines have been able to produce artificial snowflakes. The flakes formed were tight groupings of bubbles that were moist and had a tendency to clump together. This caused difficulty in dissipation. Additionally, there were concerns regarding moisture buildup in the area in which the machine was used. The problems of slippery floors, surfaces, and staining from the product have not been overcome. In an attempt to overcome these problems, people have attempted the use of fans in order to more widely distribute the artificial snow produced by these earlier machines. However, the flakes tend to form agglomerates which are not substantially effected by the auxiliary fans. These auxiliary fans do not overcome the physical difficulty of moisture buildup or the danger, which it presents.

The current invention overcomes these deficiencies. It provides for the creation of illusionary snow by an apparatus that utilizes a solution, which is commercially available as FG-100 Evaporative Snow (manufactured by Snow Masters, Plantation Fla.) drawn into a turbulent carrier wave of air at the same point at which the flakes are produced. The preciseness of placement of the carrier wave prevents tight clumps from forming, and causes greater separation between the flakes. Once the individualized flakes are carried from the machine, the evaporative process occurs and prevents moisture buildup.

BRIEF DESCRIPTION OF THE DRAWINGS

FIG. 1 shows a complete illusionary snow machine that incorporates all of the aspects of the invention.

DETAILED DESCRIPTION OF THE PREFERRED EMBODIMENT

Figure 2:
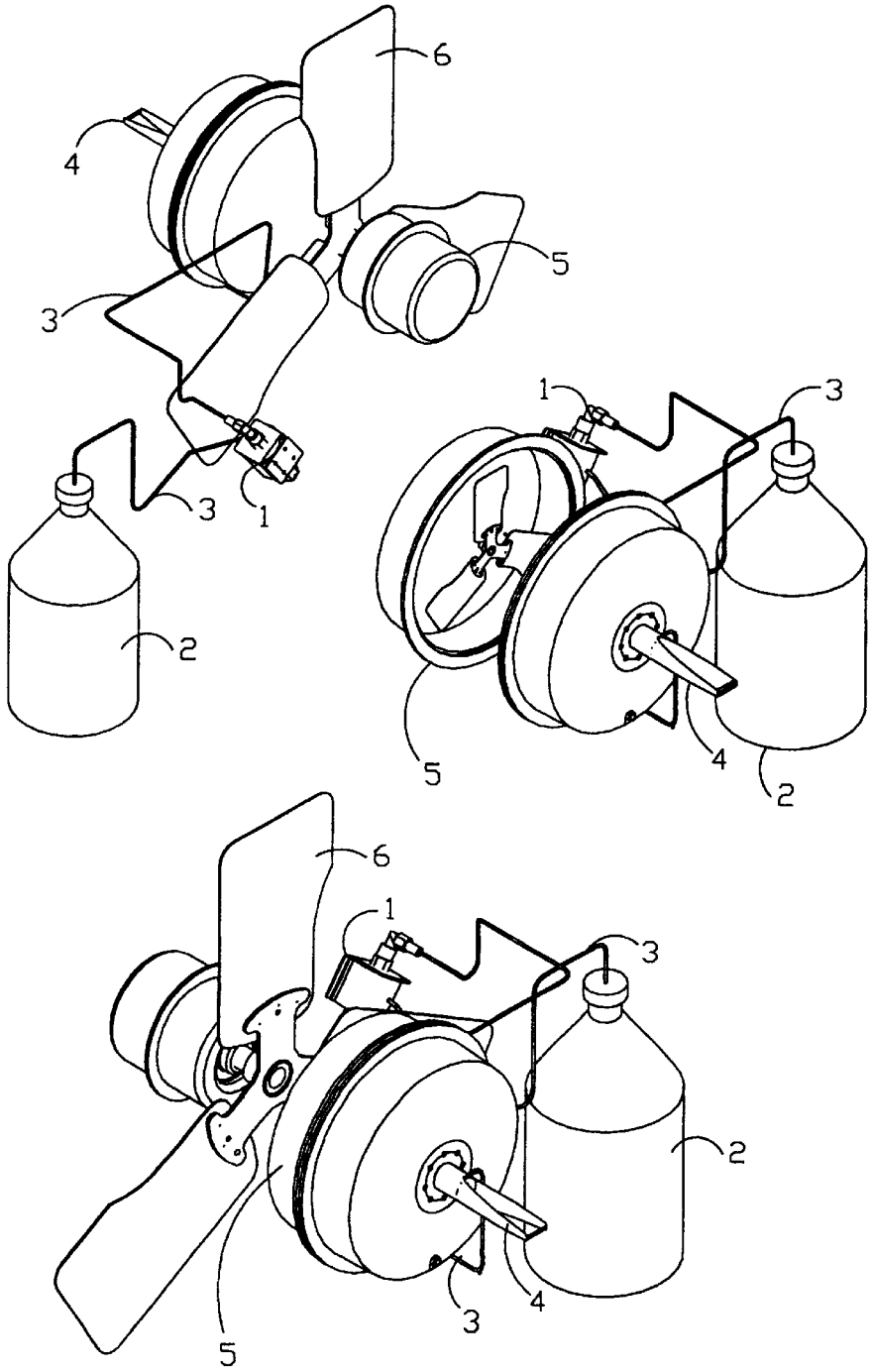
FIG. 2 illustrates the pump with connecting hose and the flake generator.

The illusionary snow solution 2 under pressure is drawn into connecting hose 3 by means of an in-line liquid pump 1 at a rate of 4 ounces per minute. The liquid then continues to a flake generator 7 where it saturates a sock 4. An impeller 5 contained within flake generator 7 causes flakes to form and to be projected into the air while an integrated carrier fan 6 facilitates the distribution of individual flakes. The flake generator 7 will produce a constant 3000 cubic feet per minute of airflow. This volume of air is forced through sock 4 and holes 8, which are on the outer surface of flake generator 7. Pressure of the air coming through sock 4 causes flakes to be formed on the outer surface of said sock 4. The volume of air produced by impeller 5 that exits flake generator 7 through the holes 8 lift the flakes from the surface of sock 4. Once the flakes are lifted from sock 4, they are projected away from the apparatus by means of airflow produced by carrier fan 6. When the force of air contacts the flakes produced carrier fan 6 there are two physical phenomena that occur. First the flakes are broken into smaller particles. This is a novel part of the current invention. The other commercially available machines have a great tendency to produce larger agglomerates, which in turn lead to excessive moisture buildup in the surrounding area. Second, once the flakes are separated into smaller particles, they are more easily dispersed in the area away from the machine. Once they are in the air in this matter the overall ratio of surface area exposed to air greatly increases. With this increased surface are comes a greater ability to speed the evaporative process. These two factors combine to speed the evaporative process and make it more complete. Another novelty of the current invention lies in the design of carrier fan 6 being lined up with flake generator 7 to lift the flakes and eject them from the apparatus in a manner that is greatly increased then a machine that would not contain both of these features placed together and at a proper distance from one another. This allows the flakes to remain in the air for a longer period of time and thus increases the transit time before they reach the ground. This increased time provides more exposure to air and allows for the completeness of evaporation to occur. The final result is an evaporative artificial snowfall that is truly free from residue of any type. Additionally, the snow produced does not resemble typical artificial snow that is ejected from a carrier hose or other apparatus. The current invention lifts the illusionary snow in a manner that produces a gentle cloud of snow in a wider horizontal area. The individualized flakes provide a cloud of gently falling flakes that is truly more realistic than anything currently available.

Figure 3:
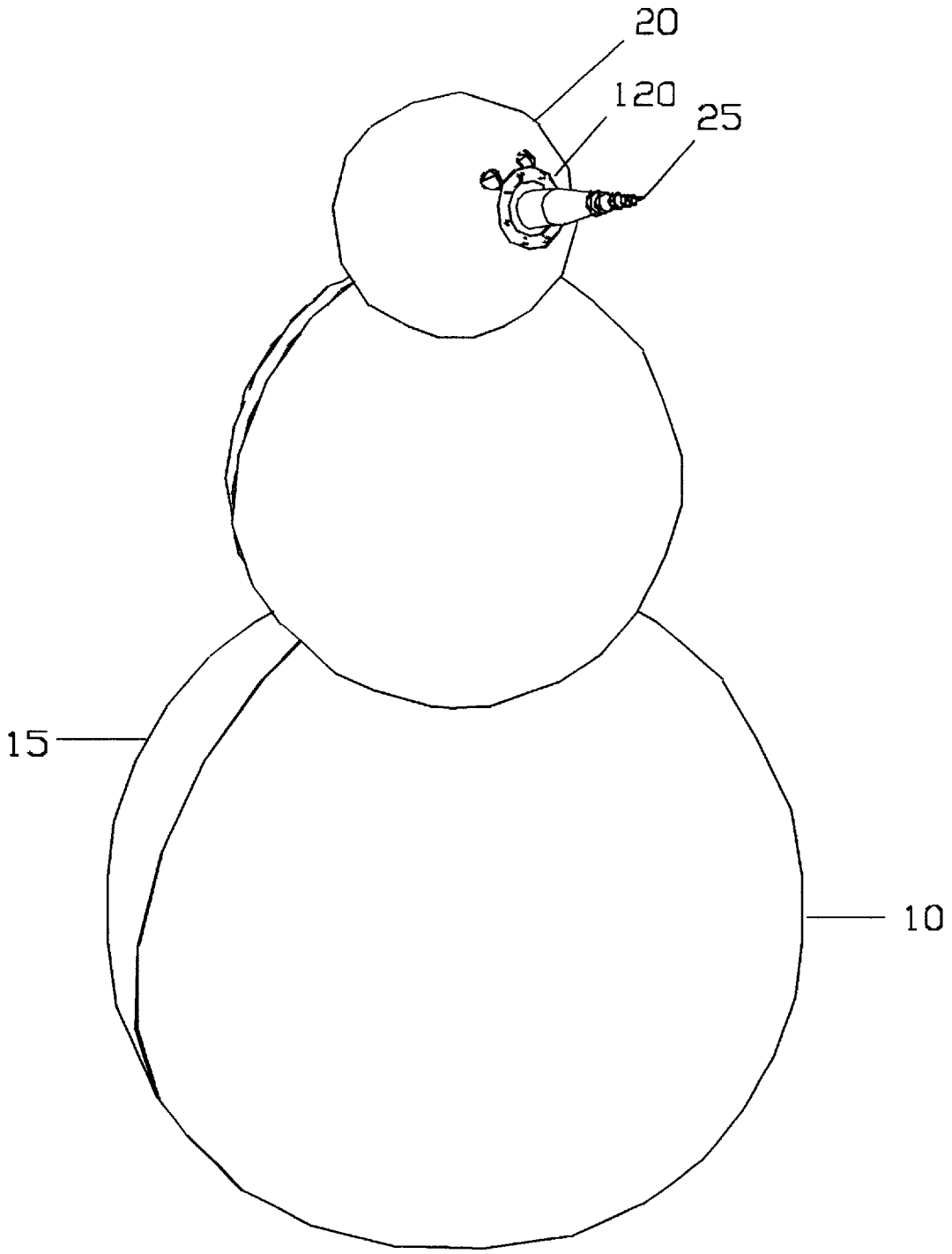
FIG. 3 shows the front of the snowman
Figure 4:
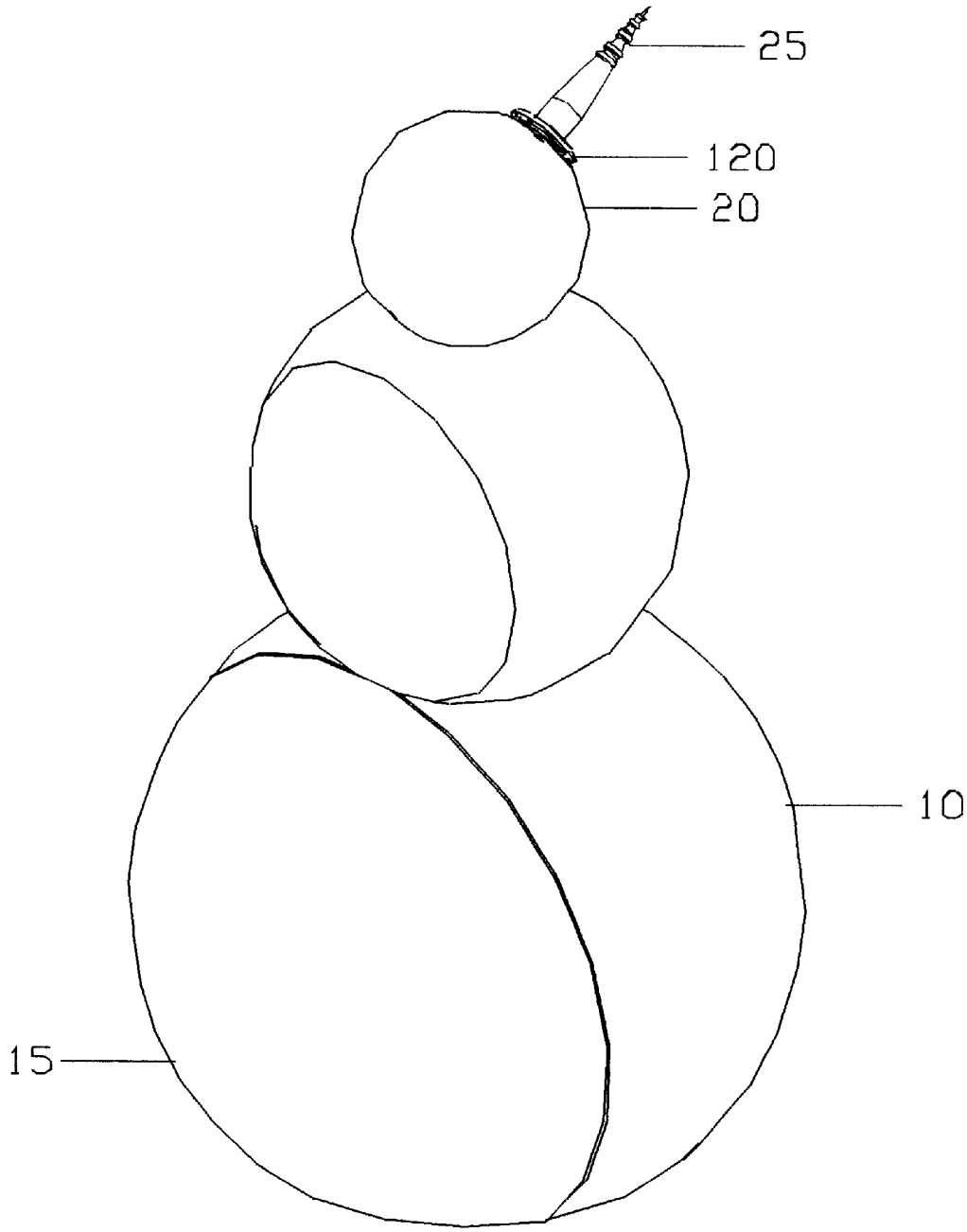
FIG. 4 shows the back of the snowman

In a preferred embodiment the apparatus can be housed within a snowman 10, which is shown in FIG. 3. The head of the snowman 20 can house a fabric sock 25. There are orifices 120 that allow air produced by the flake generator to project the snow from said sock 25. The rear of the snowman comprises a lower cover 15 on the base potion of the snowman. FIG. 4 shows the back view of snowman 10. FIG.

Figure 5:
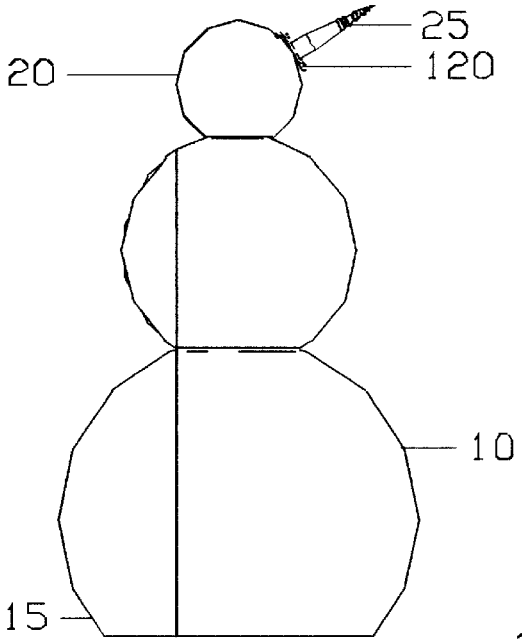
FIG. 5 shows a side view of the snowman
Figure 6:
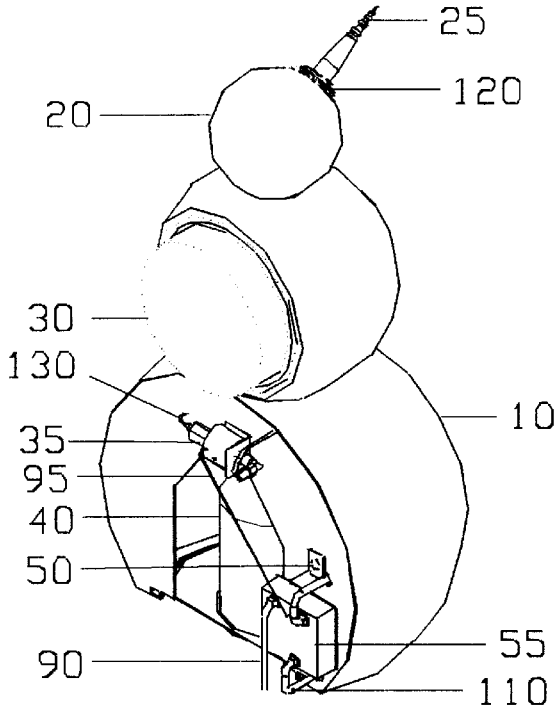
FIG. 6 Shows the back of the snowman with the cover removed and the arrangement of the parts
Figure 7:
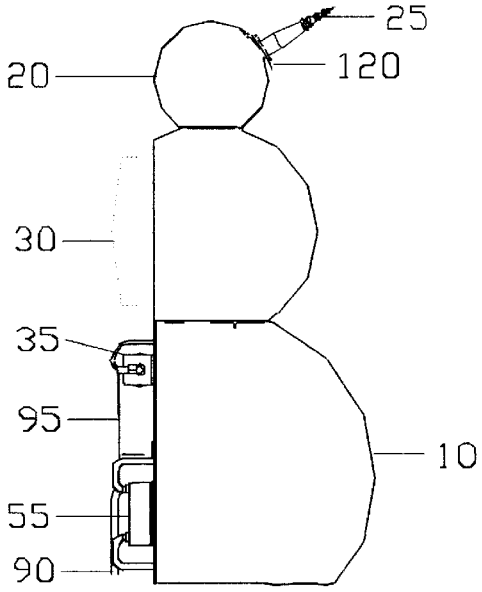
FIG. 7 shows a side view of the snowman with the back cover removed
Figure 8:
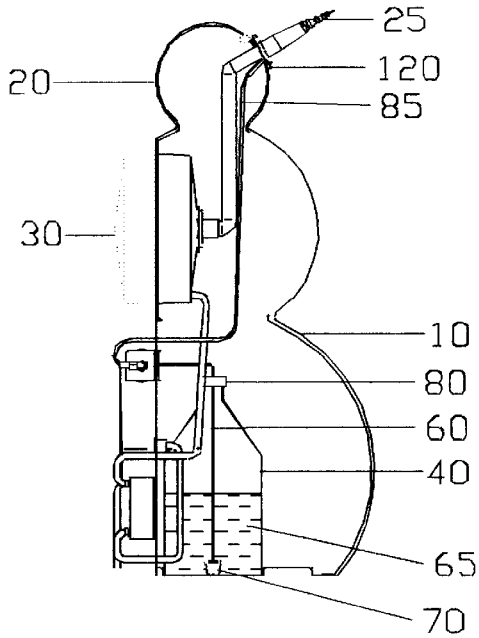
FIG. 8 is a side view cross section showing placement of the illusionary snow solution in the base of the snowman
Figure 9:
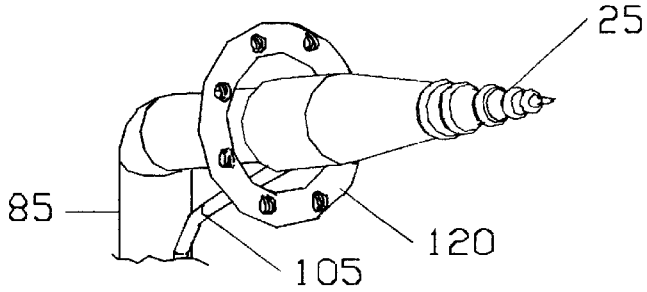
FIG. 9 illustrates the nozzle assembly
Figure 10:
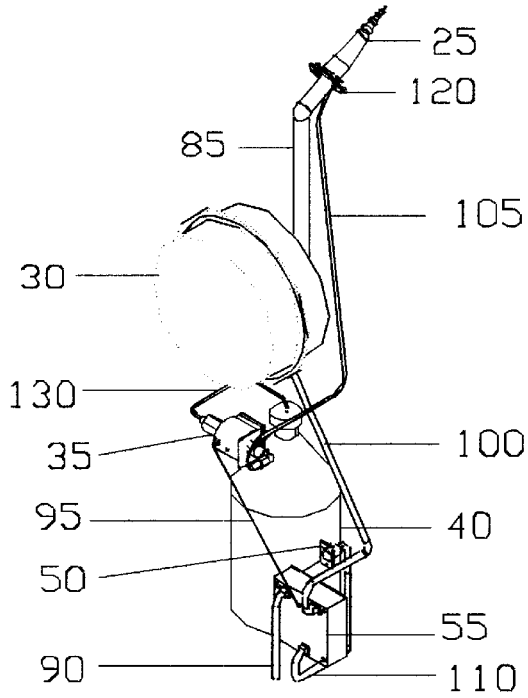
FIG. 10 illustrates the arrangement of the functional parts without the snowman
Figure 11:
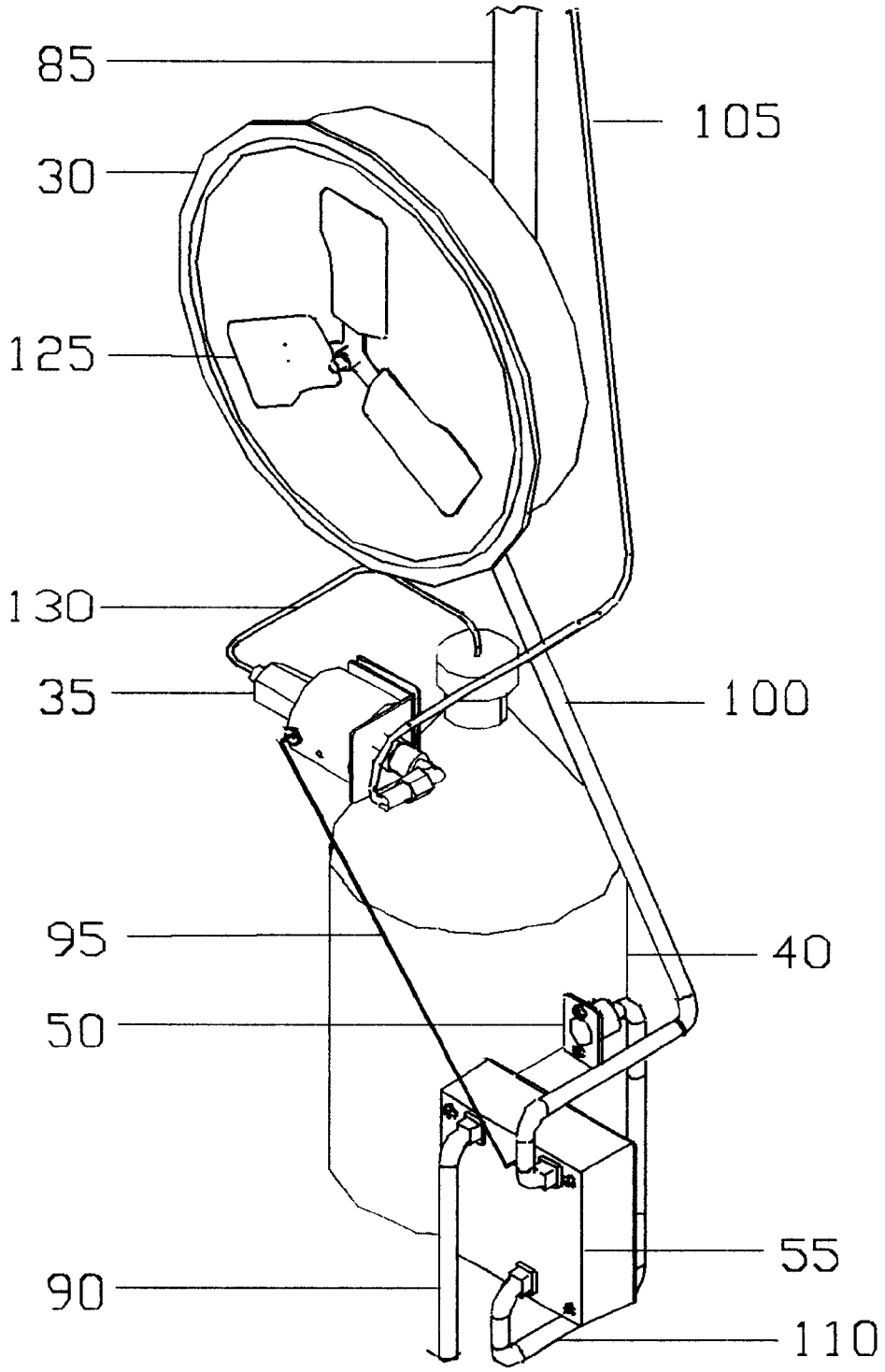
FIG. 11 illustrates the arrangement of the functional parts without the snowman and showing the blower of the flake generator

5 is a side view of the subject invention. FIG. 6 shows middle section of the snowman in which flake generator 30 is housed. When the lower cover 15, seen in FIG. 5, it exposes the elements shown in FIG. 6. There is sufficient space to place a container 40, which holds the evaporative snow solution. Said elements include a pump 35, which is placed into a container of solution 40. Said pump is operated electronically by electrical cord 90 which provides power to the power supply 55 which tan sends power to said pump through a signal received at 55 which is controlled by an external on/off switch 110 which is controlled by the user. Transmission line 95 sends the power to said pump 35 which pumps the solution from container 40 through solution line 130. FIG. 7 shows a side view of the elements as stated. FIG. 8 shows a cross section cut away of the elements of the subject invention. All elements numbered are as previously described. Solution line 60 extends into solution container 40 and is submerged in solution 65. Weight 70 holds said line 60 in place on the bottom of container 40. The solution is drawn by pump 35 through solution line 60. The solution cap 80 connects solution line 60 with solution line 130. Pump 35 draws the solution through lines 60 and 130. An air line 85 is shown which connects to base the nozzle assembly. FIG. 9 is a close up of the nozzle assembly. The solution is delivered to the sock 25 through solution delivery line 105. Air line 85 directs air, which is created by flake generator 30 and connects to the nozzle assembly has a base 120, which connects to the head of the snowman 20. Said flake generator can produce air volume of about 1000–3000 cubic feet per minute (CFM). Said base has a plurality of holes, which allows air to be directed on the outer surface of said sock 25. The air lifts the snow, which is formed on sock 25. The effect is a snowman that has a sock 25 for a nose, and, when in use, snow is projected outward from said sock.

The preferred embodiment does not require the carrier fan. The air volume needed to project the snow away from the snowman is small enough that the air created by the impeller alone, without the carrier fan, will project the flakes away from the snowman. Additionally, because there is not a need for the same velocity of air when the invention is placed inside a snowman, or other themed housing, the pump can be adjusted to deliver solution at a rate in the range of 1–4 ounces/min.

The method for producing an illusionary snowfall which employs an evaporative snow solution, is a method comprising the steps of:

drawing said evaporative snow solution into an apparatus through a hose, which is connected to a pump, directing said solution from said pump to a flake generator, which forms flakes on the outer surface of a sock, said flake generator comprises an impeller which disperses evaporative snowfall away from the apparatus.

The machine described is embodied in a snowman. The functional parts can be formed into any desired figure. The invention can be used inside an apparatus in the shapes which include but are not limited to: Christmas Tree, Snowflake, Raindear, Santa Claus, or any other holiday or winter themed figures.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A machine for producing an evaporative snow as small individualized particles which are easily dispersed, are free from agglomerates and leave no moisture or residue in the area of use, said machine comprising a pump to deliver an evaporative snow solution to a flake generator, said flake generator comprising an impeller which causes flakes to form on the surface of a sock, said flakes are dispersed from said sock by the air flow of 1000–3000 cubic feet per minute, created by said impeller, and said machine contained in a winter themed housing.

2. The machine of claim 1 in which the pump operates at a rate of 1–4 ounces per minute.

3. The machine of claim 1 in which the impeller lifts the illusionary snow off said sock.

4. The machine of claim 1 in which the impeller creates airflow to further disperses the illusionary snow into an area away from the machine.

5. The winter themed housing of claim 1 wherein said housing is in the shape of a snowman, Christmas Tree, snowflake, reindeer, or Santa Claus.

6. The winter themed housing of claim 5 wherein said housing is in the shape of a snowman.

7. A method for producing an illusionary snowfall which employs an evaporative snow solution, said method comprising the steps of:

drawing said evaporative snow solution into an apparatus through a hose, which is connected to a pump, directing said solution from said pump to a flake generator, which forms flakes on the outer surface of a sock, said flake generator comprises an impeller which disperses illusionary snowfall away from the apparatus by creating an air flow of 1000–3000 cubic feet per minute.

8. The method of claim 7 wherein said illusionary snowfall emanates from a winter themed housing.

9. The method of claim 8 wherein said winter themed housing is in the shape of a snowman, Christmas Tree, snowflake, reindeer, or Santa Claus.

10. The method of claim 9 wherein said winter themed housing is in the shape of a snowman.

* * * * *